United States Patent [19]

Ducret

[11] Patent Number: 4,793,063

[45] Date of Patent: Dec. 27, 1988

[54] PUNCH GUN

[76] Inventor: Lucien C. Ducret, 9 Tod's Driftway, Old Greenwich, Conn. 06870

[21] Appl. No.: 32,770

[22] Filed: Mar. 31, 1987

[51] Int. Cl.[4] ..... B26F 1/02

[52] U.S. Cl. ..... 30/360; 30/277; 30/DIG. 4

[58] Field of Search ..... 30/DIG. 4, 360, 367, 30/277, 301, 316; 227/9, 10

[56] References Cited

U.S. PATENT DOCUMENTS

| | | | |
|---|---|---|---|
| 2,017,329 | 10/1935 | Temple | 30/277 X |
| 2,133,364 | 10/1938 | Temple | 30/DIG. 4 X |
| 3,024,666 | 3/1962 | Haskell et al. | 30/277 X |
| 3,074,165 | 1/1963 | Davis | 30/DIG. 4 X |
| 3,269,011 | 8/1966 | Herrstrum | 30/360 |
| 3,564,716 | 2/1971 | Burrows | 30/360 |
| 3,863,341 | 2/1975 | Ramer | 30/DIG. 4 X |

FOREIGN PATENT DOCUMENTS

| | | | |
|---|---|---|---|
| 919940 | 9/1954 | Fed. Rep. of Germany | 30/DIG. 4 |

*Primary Examiner*—E. R. Kazenske
*Assistant Examiner*—Michael D. Folkerts
*Attorney, Agent, or Firm*—DeLio & Associates

[57] ABSTRACT

An explosive actuated hand tool for cutting clean holes in sheet material, wherein the explosive force causes a piston to pull a punch toward a die, the material being located between the punch and die. Convenience and safety features include means for arming the firing mechanism by rotation of a locking ring which secures a cartridge in its chamber and means to prevent movement of a firing pin unless a lever has been moved from an OFF position to the ON position.

16 Claims, 3 Drawing Sheets

PUNCH GUN

BACKGROUND OF THE INVENTION

This invention relates to an explosive actuated hand tool for forming clean holes in sheet metal, with particular reference to electrical junction boxes and the like. Such boxes may be manufactured with one or more standard openings, as for a main cable, but frequently need to be further perforated to accommodate varying numbers of additional cables or wires as required by the electrical system being installed.

The formation of holes in junction boxes has heretofore been effected by means of a "chassis punch" which usually consists of a punch having two sharp pointed sections which nest in a die. To start punching a hole, a starter hole is drilled, the die and punch are positioned on opposite sides of the sheet metal and a bolt is inserted through the die and sheet metal hole and secured into the punch. Turning the bolt with a wrench draws the punch and die together and forces the sharp edges of the punch to cut the sheet metal. This operation takes considerable effort when done by hand. A pneumatic wrench, if available, makes it much easier.

SUMMARY OF THE INVENTION

The new tool comprises a body containing a piston, movable in a cylinder and provided with a rod having a threaded end on which a punch can be secured, with a metal cutting edge facing a die through which the rod also passes. The punch, die and rod are assembled with the rod passing through a starter hole in the metal box wall. A cartridge chamber communicates with the cylinder at a point such that, when an explosive force is applied to the piston, it causes the rod to draw the punch toward the die, thereby cutting the workpiece, i.e. the pre-perforated sheet metal box wall. The punch and die are separable from the rest of the tool and are sized according to the size of the hole to be made.

OBJECTS OF THE INVENTION

An important object of the invention is to provide a hand tool for cutting holes in junction boxes and the like with a minimum of physical effort.

It is a further object of the invention to provide such a tool which has adequate power and is relatively light in weight and simple to operate.

It is another object of the invention to provide such a tool with built-in safety features, both as to the firing of the cartridge and disposed of the gasses resulting therefrom.

It is still another object of the invention to provide certain improvements in the form, construction and arrangement of the several parts whereby the above-named and other object may effectively be attained.

BRIEF DESCRIPTION OF THE DRAWINGS

The tool being entirely self-contained, its orientation in space depends on the location and position of the sheet metal "workpiece" to be cut. The workpiece is here shown and described as being in a horizontal position and the tool will be described in a position to cut a hole in the sheet metal as shown.

DETAILED DESCRIPTION OF THE PREFERRED EMBODIMENT

Figure 2:
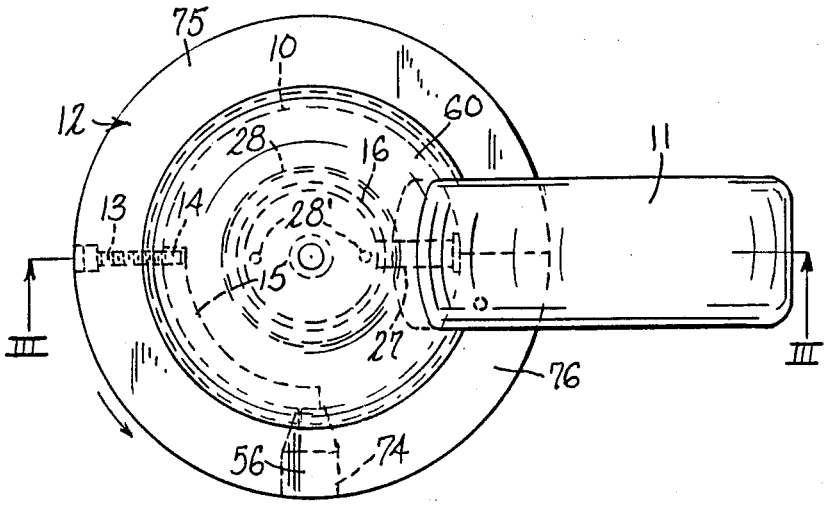
FIG. 2 represents a top plan view of the tool.

Referring to the drawings, the punch gun is shown as comprising a cylindrical body portion 10 and a pistol grip portion 11, which may be at least partially integral with the body portion. The end portion of the body spaced from the pistol grip is fitted with a rotatable cylindrical ring 12, the movement of which is limited by the set screw 13, having its tip end 14 projecting into a groove 15 which extends through an arc of 90° around the surface of the body portion, as shown in FIG. 2.

Within the body portion is the cylindrical main bore 16, containing a spool-shaped piston 17 which has a central mass 18 between two identical disks 19 and 20. The piston rod 21 projects from the disk 20 through a hole 22 in the end wall 23 of the body portion, the outer end of the rod being threaded as shown at 24. An annular shelf 25 is formed in the wall of the bore a short distance from the end wall 23 to limit the movement of the piston and to provide what may be called a "firing chamber" between the disk 20 and the end wall 23. The bore has a longitudinal exhaust groove 26 in its wall, starting at a selected distance from the shelf 25 and extending almost to the opposite end of the bore, past the disk 19. A small bore 27, constituting the cartridge chamber, extends through the body wall a short distance from the end wall 23, the outer edge of the cartridge chamber being beveled and its axis being perpendicular to the axis of the bore 16.

The exhaust end of the bore 16 is closed by a threaded plug 28 provided with vent holes 28'.

The firing mechanism includes a firing pin 30, mounted in a hole 31 through the wall of the ring 12, with the radially inner end of the pin in a position to be aligned with the cap of the cartridge 63, upon rotation of the ring, and the outer end portion of the pin projecting into a chamber 32 provided in the outer wall of the ring. A small leaf spring 33 has one end fixed to a wall of the chamber 32 and its other end engages the pin 30 at a point intermediate between the ends of the pin, the spring being angled to insure the return of the firing pin to its rest position (shown in FIG. 3) after it has fired a cartridge.

The firing pin is advanced by the movement of an actuating rod 34, slidably mounted in a hole 35 extending from the chamber 32 toward the trigger mechanism, the rod 34 having a beveled end surface 36 engageable with the outer end 37 of the firing pin. After firing (FIG. 4) the rod 34 is returned to its rest position (FIG. 3) by a spring 38 acting on the washer 39 which is fixed on the actuating rod.

Figure 3:
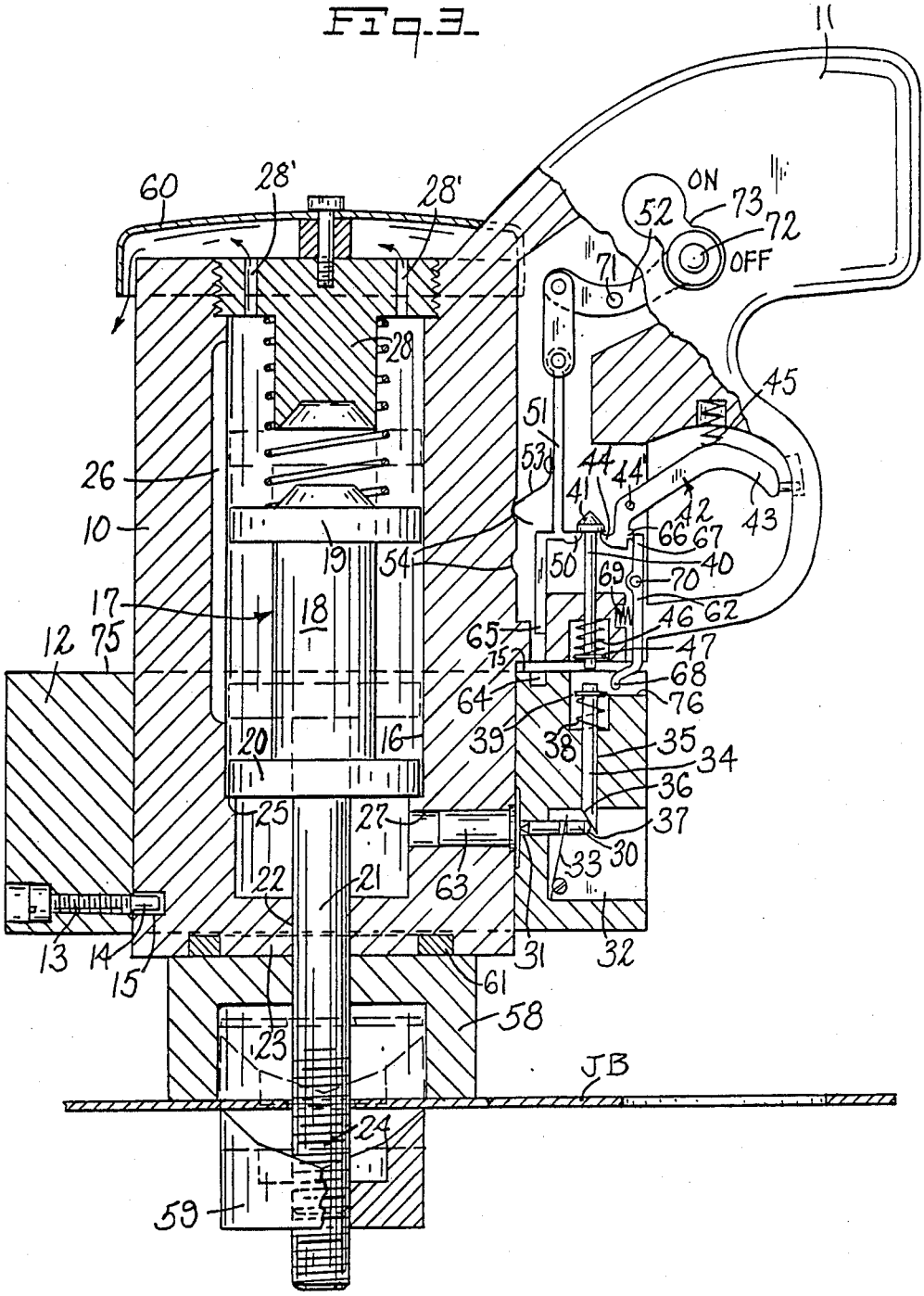
FIG. 3 represents a section on the line III—III of FIG. 2, showing the locking ring in safe position.

The trigger pin 40 is slidably mounted in a portion of the handle. It is provided with an upwardly beveled head 41, and the trigger 42, which is a simple lever having a finger portion 43 and a hook end 44 pivoted at 44', is biased by spring 45 toward the position where the hook will catch under the head 41, as shown in FIG. 3. In this position the trigger pin 40 is raised and the strong spring 46, bearing against a washer 47, is compressed. The head 41 is also engaged by the projection 50 on the safety slide 51 which is actuated by the ON-OFF button 72 in the handle. The slide may be stabilized by a leaf spring 53, adapted to snap into recesses 54 in the body wall.

The safety slide linkage includes a lever 52 which pivots about pin 71 as button 72 is moved between the ON and OFF positions to respectively disengage (FIG. 4) and engage (FIG. 3) safety slide projection 50 and trigger pin head 41. Safety lever 52 is flexible in a direction normal to the plane of the drawing in FIGS. 3 and 4 so that button 72 may be depressed into grip 11 to avoid detents 73 as it is moved between ON and OFF positions.

Safety slide 51 includes a forward projecting end 65 which is received in complimentary cavity 64 on the upper surface 75 of ring 12 when lever 52 is in the ON position. Cavity 64 is positioned to ensure that when safety slide 51 is in the ON position, trigger pin 40 is properly aligned with actuating rod 34.

The preferred embodiment of the present invention also includes an offset trigger lock lever mechanism to arm and disarm trigger 42 automatically. The lock lever mechanism comprises a lever 62 pivotable about a pin 70 in the same plane as trigger 42 and includes a rearward lever end 67 which is adapted to engage a projection 66 on trigger 42 near the hook end 44. As shown in its armed position in FIG. 3, lever end 67 rests against the end of projection 66 and allows full movement to trigger 42. As trigger finger portion 43 is squeezed to release trigger pin 40 (FIG. 4), projection 66 moves beyond lever end 67 and permits compression spring 69 to pivot lever 62 and move lever end 67 against the side of trigger projection 66 and lock trigger 42 in the fired position, thereby effectively disarming it.

Figure 5:
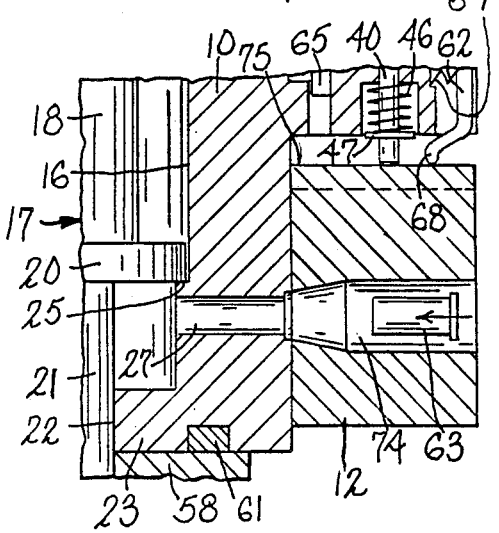
FIG. 5 represents a detail section similar to that shown in FIGS. 3 and 4, with the locking ring rotated to open the cartridge chamber for insertion or removal of the cartridge.

To remove a spent cartridge from cartridge chamber 27 and reload a fresh cartridge, an access hole 74 is provided through ring 12 at a position approximately 90° from firing pin chamber 32. To open cartridge chamber 27 it is only necessary to place safety button 72 in the OFF position (FIG. 3) to disengage safety slide end 65 from ring cavity 64 to recock trigger pin 40, and thereafter rotate ring 12 until access hole 74 is aligned with chamber 27, as shown in FIG. 5. The arc of rotation of ring 12 between firing and loading positions corresponds to the degree of rotation permitted by screw 13 in groove 15.

Figure 1:
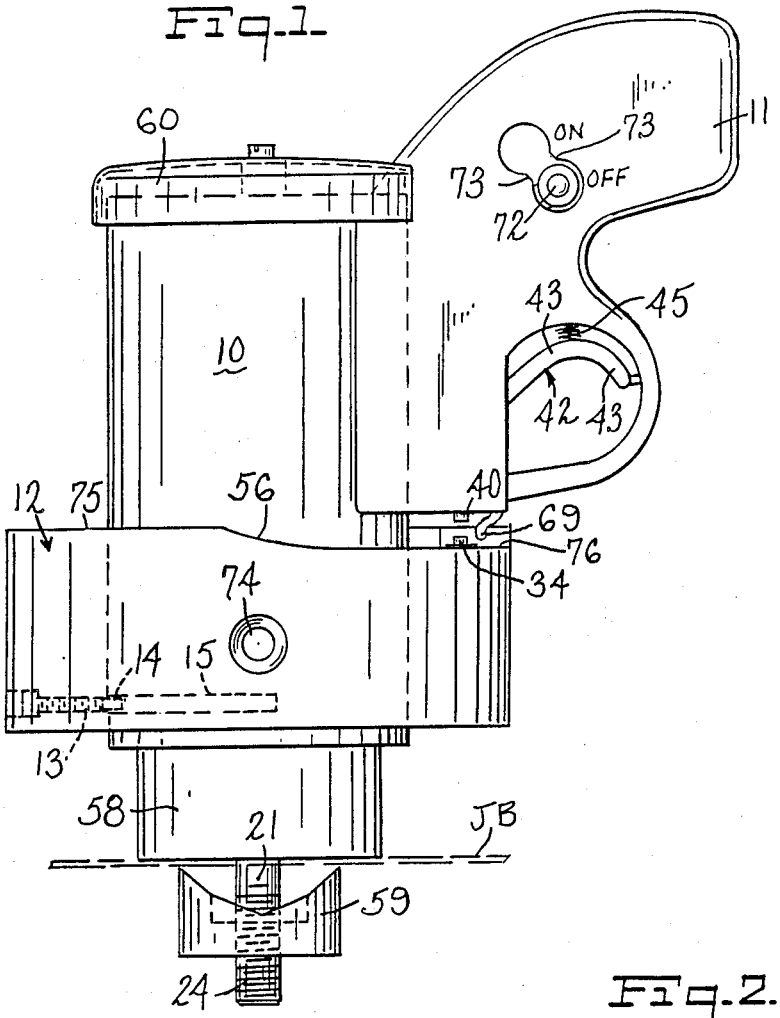
FIG. 1 represents a side elevation of the tool, with the trigger locked in "OFF" position.
Figure 4:
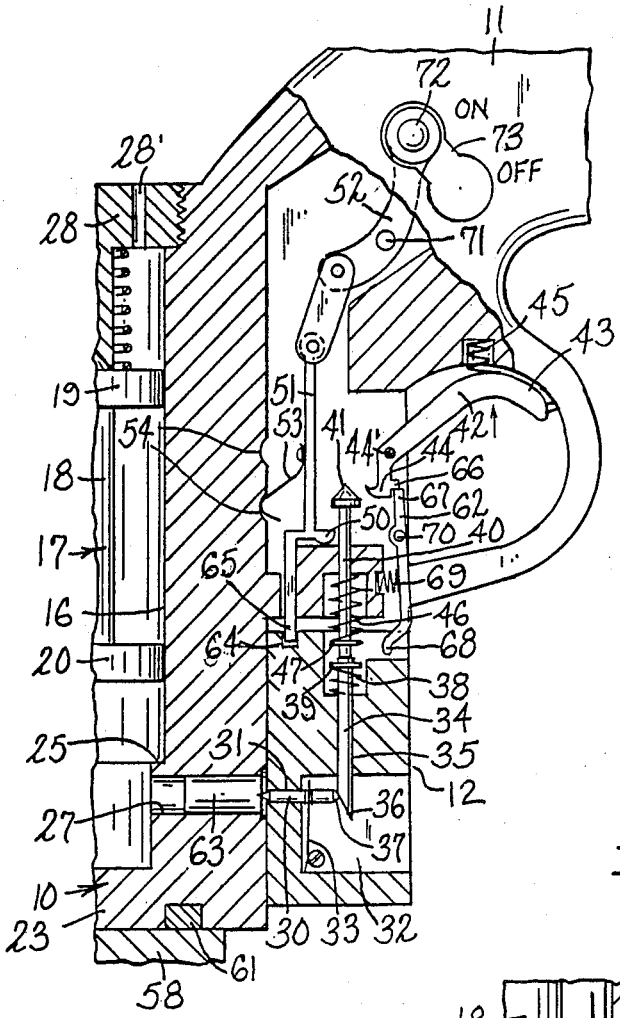
FIG. 4 represents a detail section similar to the section shown in FIG. 3, with the trigger lock in "ON" position.

To rearm the trigger mechanism at the same time that the cartridge chamber is being reloaded, the upper surface 75 of ring 12 includes a ramp area 56 which merges with a lower shelf portion 76, as shown in FIG. 1. Ramp area 56 extends for approximately 20° from ring access hole 12 toward firing pin chamber 32, while lower shelf 76 extends approximately 70° to the area of actuating rod 34 to provide a relief for the offset lever end 68 of trigger lock lever 62 (FIGS. 3 and 4). The total arc of ramp 56 and lower shelf 76 again correspond to the degree of rotation provide by screw 13 in groove 15 between ring firing and loading positions. After a cartridge is fired and the trigger 42 is disarmed by locking lever 62, the rotation of ring 12 toward the loading position causes the offset end 68 of locking lever 62 to be contacted by ramp 56 to urge offset end 68 to the left as shown in the figures and against the bias of spring 69. As ring upper surface 75 is brought into position under lever offset end 68 in the loading position (FIG. 5), opposite end 67 of lever 62 is moved to the right to its rest position to release trigger projection 66 and allow trigger 42 to return to an armed position as shown in FIG. 3. Head 41 of trigger pin 40 will now be held and secured by both trigger hook 44 and safety projection 50.

After reloading, ring 12 may be rotated back to the firing position at which time trigger pin 40 is coaxially aligned with firing pin actuating rod 34.

It is advisable to provide a shield 60, covering the vent holes 28' in a manner to direct the gases away from the operator, as shown in FIG. 3.

In operation, to punch a clean hole in a sheet metal junction box or the like (JB), the operator first drills a small hole, centered on the desired hole site and large enough to receive freely the threaded end 24 of the piston rod 21. A cup-shaped die 58 is then placed on the threaded end of rod 21 which is passed through the drilled hole; the sharp-edged punch 59 is screwed onto the rod end 24 and tightened to the position shown in FIG. 3. The operator then moves the ON-OFF lever to "ON" position, leaving the trigger pin free to move when released by the trigger hook, and the trigger is pulled to fire the cartridge.

The explosive force drives the relatively heavy piston away from the end 23 of the bore, and the sharp edges of the punch cooperate with the adjacent edges of the die to cut a clean hole in the workpiece, whatever it may be. The punch is shown as being somewhat cup-shaped with a double-beveled interior which provides great strength.

It is intended that punches and dies should be provided in matched sets covering a range of sizes, as may be needed in different installations. A ring magnet 61 may be provided on the adjacent end of the tool body to stabilize the position of the die. In every instance the punching operation starts with the operating parts in the positions shown in FIG. 3, the piston disk 20 resting on the shelf 25 so that the firing chamber has its minimum volume and the gases from the explosive charge will have maximum effect in moving the piston away from the end wall 23; the force is equivalent to a sharp blow on the end of the rod 21 and a clean cut in the workpiece (JB) is assured. As soon as the disk 20 has passed the lower end of the exhaust groove 26 the gases are released through the groove and vent holes 28', being then directed away from the operator by the shield 60.

It will be noted that this tool differs from conventional explosive actuated tools, wherein a confined projectile does this work, in that the detonation is here used to retract a piston which pulls a punch toward a die. The action is all directed and effected internally, making the tool inherently safe.

It will thus be seen that the objects set forth above, among those made apparent from the preceding description, are efficiently attained and, since certain changes may be made in the above device without departing from the spirit and scope of the invention, it is intended that all matter contained in the above description and shown in the accompanying drawings shall be interpreted as illustrative and not in a limiting sense.

What I claim is:

1. An explosive actuated tool comprising:

a body provided with a main bore, a firing mechanism associated with the body, and workpiece engaging elements;

the main bore being cylindrical and having a closed end and a vented end and a cartridge chamber communicating with the main bore, the firing mechanism including:

a trigger mechanism mounted on the tool body, cartridge firing means between the cartridge chamber and the trigger mechanism, and a locking member mounted on the tool body for rotation about the longitudinal axis of the main bore between a first radial position on said tool body which opens the cartridge chamber for loading and a second radial position on said tool body which closes the cartridge chamber for firing, and the workpiece engaging elements including:

a piston movably mounted in the main bore, a piston rod extending from the piston through the closed end wall of the main bore, and a punch and die both operatively associated with the piston rod.

2. The explosive actuated tool of claim 1 wherein the cartridge chamber communicates with the main bore at a point between the piston and the closed end of the bore.

3. The explosive actuated tool of claim 1 wherein the piston rod passes through the die and is secured to the punch.

4. The explosive actuated tool of claim 3 wherein the piston rod is threaded and the punch is screwed on to the piston rod.

5. The explosive actuated tool of claim 1 wherein the punch and the die are both circular.

6. The explosive actuated tool of claim 1 wherein at least a portion of the cartridge firing means is carried by the locking member.

7. The explosive actuated tool of claim 6 wherein said portion of said cartridge firing means is alternately operable and inoperable by said trigger mechanism to fire a cartridge in said cartridge chamber in the locking member second and first positions, respectively.

8. The explosive actuated tool of claim 1 further including a trigger lock mechanism for arming and disarming said trigger mechanism, and wherein the locking member is provided with means for arming the trigger lock mechanism in response to movement of the locking member between said first and second positions.

9. The explosive actuated tool of claim 1 which includes an ON-OFF switch associated with the trigger mechanism, said switch being operable in the ON position to permit actuation of the trigger mechanism only when the locking member is in the second, firing position.

10. The explosive actuated tool of claim 1 which includes venting means for spent gases from an explosion of a cartridge in the cartridge chamber and means associated with said main bore vented end to direct said gases away from a tool operator.

11. The explosive actuated tool of claim 1 wherein said firing mechanism includes a trigger lock mechanism operable to disarm said trigger mechanism in response to actuation of said trigger mechanism and operable to arm said trigger mechanism upon movement of said locking member from said second, firing position to said first, loading position.

12. An explosive actuated tool for cutting clean holes in a sheet material workpiece comprising:

a body portion provided with a main bore and having a pistol grip handle integral with the body portion, said main bore having a closed end and a vented end, and a cartridge chamber in a wall of the main bore adjacent to said closed end, a firing mechanism which includes a locking ring mounted on the tool body for rotation about the longitudinal axis of the main bore between a first position which opens the cartridge chamber for loading through an opening in the periphery of said ring and a second position which closes the cartridge chamber for firing, a trigger mechanism mounted adjacent to the handle and cartridge firing means between the cartridge chamber and the trigger mechanism, at least a portion of the cartridge firing means being carried by the locking ring, said portion being alternately operable and inoperable by said trigger mechanism in the locking ring second and first positions, respectively, and workpiece engaging elements including:

a piston movably mounted in the main bore and spaced from said closed end to provide a firing chamber, a piston rod extending from the piston through the closed end wall, and a punch and die both operatively associated with the piston rod and adapted to be assembled on opposite sides of a workpiece.

13. An explosive actuated tool for cutting sheet metal comprising:

a body provided with a main bore having a closed end and a vented end and a cartridge chamber communicating with the main bore;

a piston mounted in the main bore and movable toward said vented end by an explosive force of a cartridge in said cartridge chamber;

a punch and die operable by movement of said piston to cut said sheet metal; and a firing mechanism to fire said cartridge, said firing mechanism including a trigger mechanism mounted on the body, cartridge firing means between said cartridge chamber and said trigger mechanism, and a locking member mounted on said body for movement between a first radial position on said tool body which opens the cartridge chamber for loading and a second radial position on said tool body which closes the cartridge chamber for firing, at least a portion of the cartridge firing means being carried by the locking member, said portion being alternately operable and inoperable to fire a cartridge in said cartridge chamber in the locking member second and first positions, respectively.

14. The explosive actuated tool of claim 13 wherein said firing mechanism includes a trigger lock mechanism operable to disarm said trigger mechanism in response to actuation of said trigger mechanism and operable to arm said trigger mechanism upon movement of said locking member from said second, firing position to said first, loading position.

15. The explosive actuated tool of claim 14 further including an ON-OFF switch associated with the trigger mechanism, said switch being operable in the ON position to permit actuation of the trigger mechanism only when the locking member is in the second, firing position.

16. The explosive actuated tool of claim 14 further including a shield on said body associated with said main bore vented end to direct said gases away from a tool operator during actuation of said trigger mechanism.

* * * * *